United States Patent [19]

Lubberts

[11] Patent Number: 4,987,455

[45] Date of Patent: Jan. 22, 1991

[54] MULTICOLOR IMAGING APPARATUS

[75] Inventor: Cor Lubberts, Webster, N.Y.

[73] Assignee: Eastman Kodak Company, Rochester, N.Y.

[21] Appl. No.: 440,163

[22] Filed: Nov. 22, 1989

[51] Int. Cl.[5] ..... G03G 15/14; G03G 15/01

[52] U.S. Cl. ..... 355/271; 355/326; 355/315

[58] Field of Search ..... 355/212, 319, 326, 327, 355/23, 24, 272, 315, 271

[56] References Cited

U.S. PATENT DOCUMENTS

| | | | |
|---|---|---|---|
| 3,820,985 | 6/1974 | Gaynor et al. . | |
| 3,856,295 | 12/1974 | Looney | 355/319 X |
| 3,920,327 | 11/1975 | Kato | 355/272 X |
| 4,013,359 | 3/1977 | DuBois et al. | 355/212 X |
| 4,162,843 | 7/1979 | Inoue et al. | 355/327 |
| 4,214,831 | 7/1980 | Reesen | 355/319 |
| 4,232,961 | 11/1980 | Masuda . | |
| 4,396,274 | 8/1983 | Kollar et al. | 355/212 |
| 4,796,050 | 1/1989 | Furata et al. | 355/327 X |

FOREIGN PATENT DOCUMENTS

| | | | |
|---|---|---|---|
| 0159862 | 8/1985 | Japan | 355/315 |
| 63-96675 | 4/1988 | Japan . | |
| 0300248 | 12/1988 | Japan | 355/212 |

*Primary Examiner*—R. L. Moses

*Attorney, Agent, or Firm*—Leonard W. Treash, Jr.

[57] ABSTRACT

An endless transfer web is supported by a large diameter drum and at least one small diameter roller. Two or more imaging drums are positioned in transfer relation to the transfer web where it is backed by the large drum. Different color toner images are transferred in registration to the web to form a multicolor image which is transferred to a receiving sheet. The receiving sheet is separated from the web as the web passes around the small roller. The imaging drums can be electrophotosensitive drums with separate electrophotographic stations or drums which hold masters, for example, xeroprinting masters on their periphery.

5 Claims, 2 Drawing Sheets

MULTICOLOR IMAGING APPARATUS

TECHNICAL FIELD

This invention relates to multicolor image forming apparatus, and more specifically to an apparatus for separately forming color images on separate imaging members and transferring those images in registration to form a multicolor image.

BACKGROUND OF THE INVENTION

Pending U.S. patent application Ser. No. 304,093 to Mahoney and Benwood and U.S. Pat. No. 4,232,961 show multicolor imaging apparatus in which three or four imaging members are separately charged, exposed and toned to create toner images in different colors and those toner images are transferred in registration to an intermediate web from which they are transferred to a receiving sheet. Apparatus with separate imaging members for creation of separate color toner images is many times faster than present commercial devices in which the images are formed consecutively on a web or drum photoconductor.

As pointed out in the Mahoney et al application, the web intermediate has the advantage of lending itself to single-pass duplexing of consecutive multicolor images. Another advantage of web imaging members per se is that they can be trained around a small diameter roller to assist in separating a receiving sheet.

A number of other references show separate imaging members which create separate color toner images and transfer them directly to a receiving sheet. See for example U.S. Pat. Nos. 4,464,501; 4,162,843; 4,662,739; 4,690,542 4,809,037; and 4,835,570. In U.S. Pat. No. 4,580,889 the transfer sheets are presented to the imaging members by attaching them to the surface of a drum rather than a moving web which is shown in rest of the above references.

Maintenance of cross-track and in-track registration between toner images is a serious challenge in designing and manufacturing color apparatus having a web imaging member. In-track registration is controlled in the Mahoney et al structure by a sprocket and perforation system which automatically adjusts for variations in the speed and manufacture of the web. Reasonably good cross-track registration is obtained since the web has a tendency to follow itself over short distances reasonably well. However, for highest quality work even complex web tracking systems are unable to prevent some noticeable cross-track misregistration. This becomes more critical as materials and exposure systems are improved and provide higer resolution.

U.S. Pat. Nos. 4,378,154; 4,624,549; 4,497,570; and 3,820,985 show an electrophotographic imaging apparatus in which a protoconductive web is trained around a large roller or drum and at least one or more small rollers. The small roller has the advantage shown, for example, in 4,378,154, of assisting in separation of a receiving sheet. The large roller or drum helps maintain good separation between the image forming stations and the electrophotographic member. FIG. 4 of U.S. Pat. No. 3,820,985 shows such a drum-web structure in a color imaging device. Registration problems are not addressed or corrected in this structure.

DISCLOSURE OF THE INVENTION

It is an object of the invention to provide apparatus for forming multicolor toner images which apparatus includes a plurality of imaging members as in the prior art but which has improved registration of the color images making up said multicolor toner image.

This and other objects are accomplished by an apparatus which includes a transfer web which receives toner images from a plurality of imaging members as in the prior art. The transfer web however is supported by a large diameter drum and at least one small diameter roller. The plurality of imaging members are positioned in transfer relation with the transfer web at positions at which it is supported by the drum.

With this structure friction between the web and the supporting drum holds the web from movement as it passes through transfer relation with each of the imaging members thereby maintaining registration to an accuracy not maintainable by web tracking apparatus alone.

According to a preferred embodiment, the advantages of the web are utilized by using the small diameter roller in receiving sheet handling. For example, separation of the receiving sheet is accomplished by separating the sheet just as the transfer web passes around the roller, thereby utilizing the beam strength of the receiving sheet to assist in separation.

According to another preferred embodiment the transfer web is supported by two small diameter rollers in addition to the large diameter drum and the two small diameter rollers are used to assist in handling the receiving sheet in doing single pass duplexing.

BRIEF DESCRIPTION OF THE DRAWINGS

In the detailed description of the preferred embodiment of the invention presented below, reference is made to the accompanying drawings, in which.

DISCLOSURE OF THE PREFERRED EMBODIMENT

Figure 1:
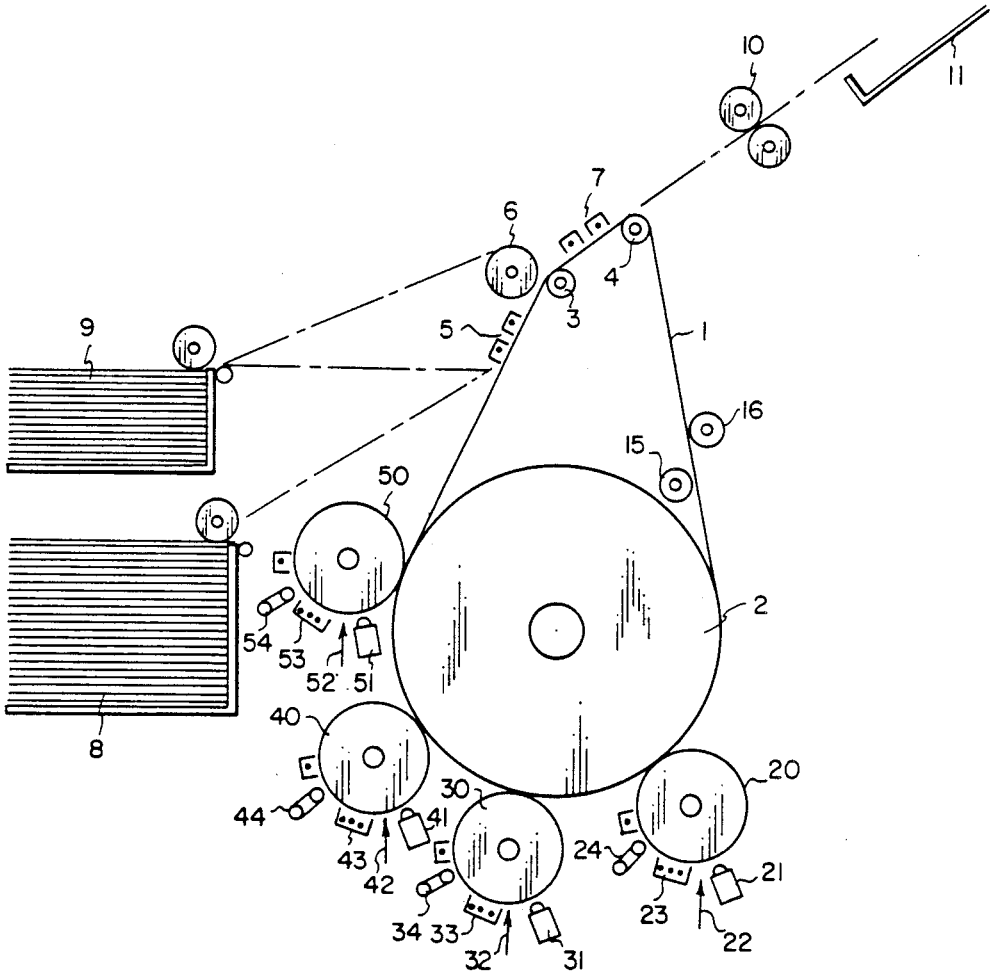
FIG. 1 is a side schematic of a multicolor toner image producing apparatus constructed according to the invention.

According to FIG. 1, an imaging web, for example, endless belt 1 is trained about large diameter drum 2 and two smaller diameter rollers 3 and 4. Belt 1 is driven by drum 2 past a series of imaging members 20, 30 ,40 and 50. As shown in FIG. 1 each of imaging members 20, 30, 40 and 50 is a drum which is rotatable through a path taking its periphery past toning stations 21, 31, 41 and 51, exposure stations 22, 32, 42 and 52, charging stations 23, 33, 43 and 53 and cleaning stations 24, 34, 44 and 54.

Belt 1 also passes into close transfer relation with a first transfer station 5, a turnover drum 6 and a second transfer station 7. Transfer stations 5 and 7 are supplied from receiving sheet supplies 8 and 9 and receiving sheets are ultimately fed through a fuser 10 and into an output tray 11.

Figure 2:
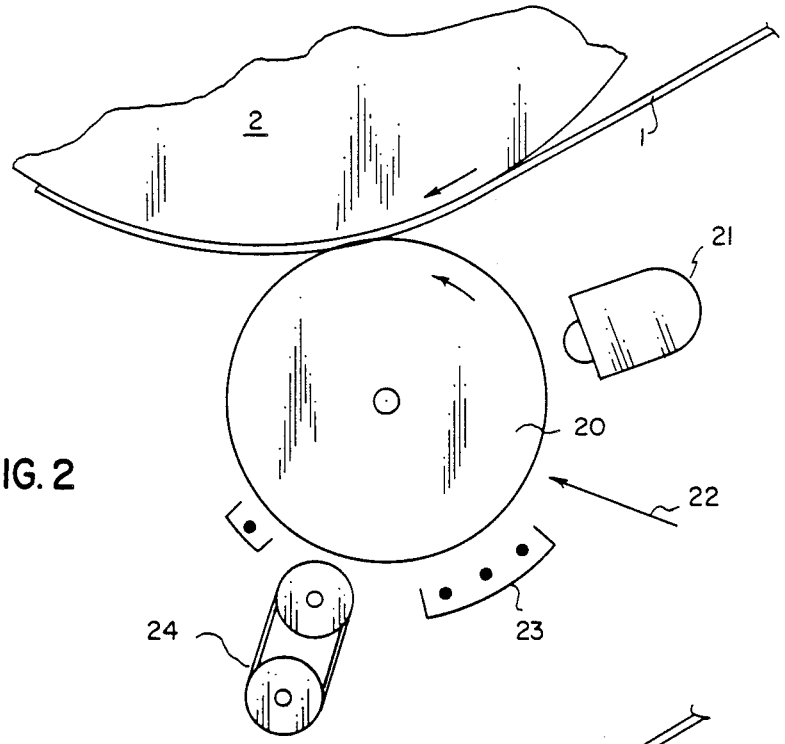
FIGS. 2 and 3 are side schematics of the imaging portions of alternative embodiments of the apparatus shown in FIG.1.

In the embodiment shown in FIGS. 1 and 2, each of imaging members 20, 30, 40, and 50 is electrophotosensitive. For example, it has a photoconductive layer at or near its surface and a surface capable of holding a charge in the dark. In operation, as seen best in FIG. 2, imaging member 20 rotates past charging station 23 where it receives a uniform charge on its periphery, exposing station 22 where it is exposed to imagewise illumination, for example, from a laser, to create an electrostatic image, and toning station 21 where that electrostatic image is toned to create a toner image defined by the electrostatic image.

Referring again to FIG. 1, the toner image on image member 20 is transferred to web 1. Similarly, toner images of different colors are created on image members 30, 40, and 50, and those toner images are transferred in registry with the image transferred from image member 20, thereby creating a multicolor image on the surface of web 1. These transfers can be accomplished by any conventional transfer system; for example, electrostatic, thermal or pressure transfer can be used.

The multicolor image is transferred to a receiving sheet fed from receiving sheet supply 8 or 9 to transfer station 5. A second multicolor image formed similarly to the first image can be transferred to the opposite side of the receiving sheet. To accomplish this, the receiving sheet is turned over on turnover drum 6 without disturbing the first multicolor image and refed to the web 1 at transfer station 7 to receive the second multicolor image. This "single-pass duplexing" is done according to a scheme well-known in the art; see for example, U.S. Pat. No.4,095,979 to DiFrancesco. With images on one or both sides, the receiving sheet is then fed to fuser 10 where both images are fused simultaneously and then transported to output tray 11. Both sides of the web 1 are cleaned by cleaning devices 15 and16. Cleaning device 15 also cleans drum 2.

This structure combines the advantages of a drum in registration of images as they are transferred from image members 20, 30, 40 and 50 with the advantages of a web in transfer and sheet separation associated with transfer stations 5 and 7. More specifically, it is critical in making a high quality multicolor image that the color images from each of the imaging members 20, 30, 40 and 50 be transferred in very tight registration to web 1. Any cross-track or in-track variation in the position of web 1 as it passes through transfer relation with web 1 as it passes through transfer relation with imaging members 20, 30, 40 and 50 will be noticeable in both loss of resolution of the image and, depending on the colors involved, a shift in hue. Prior devices (such as that shown in U.S. Pat. No. 4,232,961) maintaining cross-track and in-track image registration is a problem. For much work, these prior devices are satisfactory. However, modern electrophotohgraphic materials and exposure systems are providing the capability of greater and greater resolution. Registration is becoming the most limiting aspect in producing highest quality color images.

In general, in-track registration problems are created by variation in the speed of web while cross-track registration is affected by deviations in web tracking. The latter are not totally correctable even by sophisticated web tracking devices.

According to the invention, friction between the drum 2 and web 1 holds the web in place as it receives all four toner images. Thus, as long as drum 2 does not vary in speed or lateral position neither will a single point on web 1. The cross-track position of drum 2 and its speed (due to its inertia) can be controlled to a much finer tolerance than can a web trained about small rollers. The invention thous improves registration in both cross-track and in-track directions.

As shown in the FIGS. the 1 is in contact with the drum 2 and is driven by drum 2 throughout the path of the web through transfer relation with each of imaging members 20, 30, 40 and 50. With adequate friction between web 1 and drum 2, there is a very small likelihood of any shift of the web with respect to the drum. The drum can be held to very close tolerance therby maintaining extremely accurate registration, especially in the cross-track direction. This, with this device the primary contribution to cross-track registration error from web tracking is eliminated. As in all endless web systems, a web tracking mechanism, for example, one based on edge guides, is required. However, with the invention, even the least expensive web tracking system gives better cross-track registration than prior devices with more elaborate and expensive active tracking systems.

In-track registration is also aided because the inertia of the drum steadies the speed of the web reducing flutter and other variations. Actual in-track control of image placement can be accomplishted by mechanical linkage between drum 2 and imaging members 20, 30, 40 and 50. Exposure stations 22, 32, 42 and 52 can be controlled by an encoder responsive to the angular position of drum 2. Alternatively, the image members can be positioned exactly one image frame apart and the four exposures made simultaneously.

Significantly, the invention retains the advantages of a web. More specifically, small rollers 3 and 4 are used totrain web 1 around corners which aide in receiving sheet handling. Rollers 3 and4 are positioned to create a change in direction of web 1 thereby fcilitating separation of the receiving sheet from the web for transport first to turnover drum 6 and then to the fuser 10. obviously, if single-pass duplexing is not desired, small rollers 3 and 4 can be replaced by a single roller, with one of transfer stations 5 or 7 eliminated.

Figure 3:
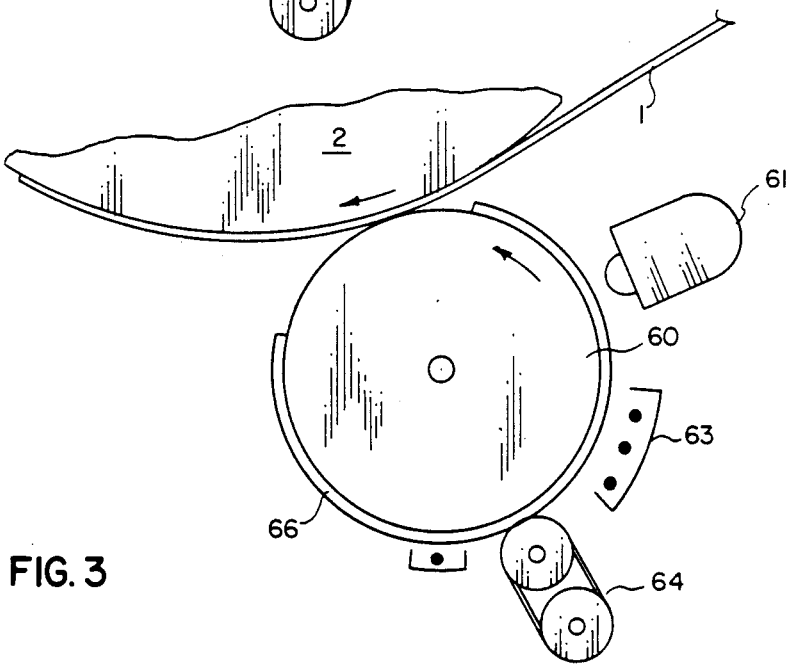

FIGS. 2 and 3 show different embodiments of the invention. FIG. 2, already discussed, shows one of the imaging members 20 shown in FIG. 1, with charging station 23, a laser exposing station 22 and toning station 21. According to FIG. 3, the exposure station is missing, and a xeroprinting master 66 has been affixed to the periphery of imaging member 60. The xeroprinting master contains a pattern of varying conductivity which is charged at charging station 63, thereby creating an electrostatic image according to the pattern of varying conductivity. The electrostatic image is toned by toning station 61 and transferred to web 1. The xeroprinting master may be affixed to the imaging members by hand, or automatically, or formed in place.

In-track registration is controlled by the accurate location of the masters. This may be accomplished using known registration pins or the like. As is also known registration pins or the like. As is also known in the art, some adjustment of the angular position of the imaging members in response to a visual inspection of the multicolor image can be provided.

In each embodiment, FIG. 2 and FIG. 3, the imaging member 20 or 60 is cleaned by cleaning station 24 or 64. Such cleaning may not be necessary for most work in the embodiment according to FIG. 3.

Thus, the invention provides an extremely productive multicolor image forming device which has the advantages of a web for handling of the receiving sheet and the advantage of a drum for maintenance of image registration.

The invention has baeen described in detail with particular reference to a preferred embodiment thereof, but it will be understood that variations and modifications can be effected within the spirit and scope of the invention as described hereinabove and as defined in the appended claims.

I claim:

1. Apparatus for forming multicolor toner images, said apparatus comprising:

a transfer web supported by a large diameter drum and at least on smaller diameter roller for movement through an endless path, a plurality of imaging members positioned in transfer relation to said transfer web at positions along said path at which said web is supported by said drum, means for forming toner images of different colors on said imaging members, means for transferring said toner images from said imaging members to said transfer web in registration to form a multicolor image, and means for transferring said multicolor image from said transfer web to a receiving sheet.

2. The apparatus according to claim 1 further including means for separating said receiving sheet from said transfer web as said web passes around said smaller diameter roller.

3. Apparatus according to claim 2 wherein each of said imaging members is an electrophotosensitive drum and said toner image forming means includes means for uniformly charging said electrophotosensitive drum and for exposing said charged drum to imagewise radiation to create an electrostatic image and means for toing said electrostatic image to create a toner image defined by said electrostatic image.

4. Apparatus according to claim 2 wherein each of said imaging members is a drum which drum includes means for receiving a xeroprinting master fixed to its periphery and said means for forming toner images includes means for charging each of said masters and for applying toner thereto to create toner images defined by xeroprinting image on said master.

5. Apparatus according to claim 2 further including a second smaller diameter roller and means for separating said receiving sheet from said web as said web passes around each such smaller diameter roller and further including means for inverting a receiving sheet after one such separation and for returning it to said web after such inversion.

* * * * *